United States Patent [19]

Prough

[11] 4,259,150

[45] Mar. 31, 1981

[54] PLURAL STAGE MIXING AND THICKENING OXYGEN BLEACHING PROCESS

[75] Inventor: James R. Prough, Glens Falls, N.Y.

[73] Assignee: Kamyr Inc., Glens Falls, N.Y.

[21] Appl. No.: 101,565

[22] Filed: Dec. 10, 1979

Related U.S. Application Data

[63] Continuation of Ser. No. 970,852, Dec. 18, 1978, abandoned, which is a continuation of Ser. No. 785,786, Apr. 8, 1977, abandoned.

[51] Int. Cl.[3] ..... D21C 9/02; D21C 9/10; D21C 9/18

[52] U.S. Cl. ..... 162/40; 162/56; 162/60; 162/65

[58] Field of Search ..... 162/40, 60, 65, 241, 162/251, 56, 19, 90; 8/111

[56] References Cited

U.S. PATENT DOCUMENTS

| | | | |
|---|---|---|---|
| 1,642,978 | 9/1927 | Thorne | 162/65 |
| 3,251,730 | 5/1966 | Watanabe | 162/65 |
| 3,660,225 | 5/1972 | Verreyne | 162/65 |
| 3,754,417 | 8/1973 | Jamieson | 162/65 |
| 3,830,688 | 8/1974 | Mannbro | 162/65 |
| 3,832,276 | 8/1974 | Roymoulik et al. | 162/65 |
| 3,944,463 | 3/1976 | Samuelson et al. | 162/65 |
| 3,963,561 | 6/1976 | Richter | 162/65 |
| 3,966,542 | 6/1976 | Oldshue | 162/57 |
| 4,029,579 | 6/1977 | Jacobsen et al. | 162/251 X |
| 4,041,560 | 8/1977 | Jacobsen | 162/60 X |

FOREIGN PATENT DOCUMENTS

| | | | |
|---|---|---|---|
| 929711 | 7/1973 | Canada | 162/65 |
| 2450608 | 8/1975 | Fed. Rep. of Germany | 162/65 |
| 2534948 | 2/1976 | Fed. Rep. of Germany | 162/65 |
| 429156 | 6/1975 | U.S.S.R. | 162/65 |

OTHER PUBLICATIONS

Kleppe et al., "Oxygen/Alkali Delignification at Kamyr Digester Blowline Consistency–A Status Report", *TAPPI*, vol. 59, No. 11; Nov. 1976.

Coetee; *Pulp and Paper Magazine of Canada;* "Continuous Saporal Bleaching Operating Experience"; vol. 75, No. 6, Jun. 1974.

*Primary Examiner*—S. Leon Bashore
*Assistant Examiner*—Steve Alvo

[57] ABSTRACT

A method and apparatus for the treatment of fiber material by oxygen bleaching. Digested cellulosic fiber material is treated with oxygen to reduce the Kappa number thereof further to about 15 or below. The reaction products are removed immediately after formation, and during the oxygen bleaching process. The fiber material is at a first consistency of about 8 to 15% consistency, and treatment with oxygen is accomplished by mixing the pulp with $O_2$, NaOH solution, and water to thereby form an integral mixture of pulp with oxygen at a second consistency, thickening the integral mixture to return it to generally its first consistency, and repeating the mixing and thickening until pulp of a desired Kappa number (15 or below) is reached. The pulp is then washed and may be subsequently treated to reduce the Kappa number thereof to any desired value. A thickener is used which can thicken pulp at superatomspheric pressures and at a temperature greater than 100° C.

3 Claims, 4 Drawing Figures

PLURAL STAGE MIXING AND THICKENING OXYGEN BLEACHING PROCESS

CROSS-REFERENCE TO RELATED APPLICATIONS

This application is a continuation application of Ser. No. 970,852 filed Dec. 18, 1978, now abandoned, which in turn is a continuation of application Ser. No. 785,786 filed Apr. 8, 1977, now abandoned.

BACKGROUND AND SUMMARY OF THE INVENTION

In a typical commercial mill for the treatment of cellulosic fiber material to form paper pulp, the fiber material would typically be digested to a Kappa number of about 35, and the fiber material would be bleached to reduce the Kappa number to any desired value. For instance oxygen bleaching could take place to reduce the Kappa number from 35 to 15, and then subsequently chlorine bleaching could be used to further reduce the Kappa number. Conventionally, bleaching takes place either with high equipment and energy penalties and, or with a relatively low pulp yield per ton of fiber material treated.

Existing equipment for effecting oxygen bleaching presently takes the form of one of a variety of oxygen reactors. A first type of oxygen reactor such as shown in U.S. Pat. No. 3,660,225, utilizes equipment to increase the consistency of the digested pulp (normally about 8 to 15%) to about 20 to 30% before treatment, and then the pulp is fed to the reactor for treatment. A second type of oxygen reactor is shown in U.S. Pat. No. 3,832,276, which employs apparatus for thinning the pulp from the normal digester consistency to about 2 to 5% consistency, and then feeding the pulp to the oxygen reactor. A third approach, such as shown in U.S. Pat. No. 3,963,561, employs a different type of oxygen reactor and can treat the pulp at the digester consistency of about 8 to 15%. While all such apparatus is effective for achieving the desired results, the capital investment is normally quite high, and the energy penalty associated with treatment—especially where separate dilution and thickening steps must be employed prior and/or subsequent to bleaching—is normally quite high, and the Kappa number often cannot be reduced low enough to avoid some chlorine bleaching.

In conventional systems, chlorine is used to reduce the Kappa number from 35 to about 6, with subsequent steps taken to whatever level of brightness is desired. Chemical cost is greater than for oxygen bleaching, however, and the pollution load increases significantly since the spent chemical solution cannot be returned to the system.

According to the present invention, a method and apparatus are provided which can effect oxygen bleaching at reduced capital cost and at reduced energy penalty compared to existing commercial insulations, with a reduced chemical use and pollution load compared to chlorine bleaching, and with increased yield compared to existing commercial installations.

According to one aspect of the method according to the present invention, digested pulp is treated by adding oxygen and sodium hydroxide solution thereto, to effect oxygen bleaching, reaction products being formed during oxygen bleaching, and removing the reaction products substantially immediately after formation thereof, and during oxygen bleaching, from the digested pulp.

The adding and removing steps are consecutively repeated until pulp bleached to desired Kappa numbers produced. Preferably the pulp is at a consistency of about 8 to 15%, and the removal step is accomplished by thickening the pulp to about its original consistency of about 8 to 15%. In this way, digesting can be terminated at a Kappa number of about 70 (instead of 35 as conventionally) with oxygen bleaching effecting the reduction of the Kappa number from 70 to 15 or even below 15.

According to another aspect of the method according to the present invention, cellulosic fiber material is treated by digesting the fiber material to produce digested pulp having a first consistency of about 8 to 15%, and then the pulp is oxygen bleached by mixing the pulp with $O_2$, NaOH solution, and water, thereby forming an integral mixture of pulp with $O_2$ at a second consistency less than said first consistency, thickening the integral mixture to return it to a consistency generally the same as the first consistency, and subsequently mixing and thickening until a desired level of oxygen bleaching is achieved. The oxygen bleached pulp is subsequently washed. The temperature and pressure conditions at which the bleaching is accomplished may be continuous digester conditions—a temperature over 100° C. and superatmospheric pressure.

The method, according to the present invention, may be accomplished with minimum capital expenditure by utilizing the apparatus according to the invention, the apparatus including a plurality of mixing means disposed in series in a line (i.e. digester discharging line) and including first and last mixing means, for mixing digested pulp with $O_2$, NaOH solution, and water; a plurality of thickening means disposed in the line in series and including a first and last thickening means, each thickening means being disposed in the discharge from a mixing means, and means for adding $O_2$, NaOH solution, and water to the mixing means. Means are also provided for washing the pulp discharge from the last thickening means of the series. Each thickening means preferably includes an in-line thickner capable of thickening pulp at superatmospheric pressures and at a temperature over 100° C. such as the thickener shown in co-pending application Ser. No. 676,660, filed Apr. 13, 1976, now U.S. Pat. No. 4,041,560; and Ser. No. 676,659, filed Apr. 13, 1976, now U.S. Pat. No. 4,029,579. Means are provided for recycling back to a previous mixing means in the series, liquid withdrawn from a thickening means to provide the water for mixing in the previous mixing means, and the mixing water for the last mixing means in the series is provided from the washing means, while the separated liquid from the first thickening means in the series is circulated back to effect washing in a continuous digester. The mixing means may comprise fibrilizing means for effecting at least partial fibrilizing of the pulp, and means may be provided for separating shives from the pulp discharge from the fibrilizing mixing means and for returning the shives to the fibrilizing mixing means while passing the pulp to a subsequent thickening means.

It is the primary object of the present invention to provide a method and apparatus for treating cellulosic fiber material to obtain a high pulp yield with minimum chemical use and energy penalty, and minimum capital expenditure, including oxygen bleaching of the pulp. This and other objects of the invention will become clear from an inspection of the detailed description of the invention and from the appended claims.

DETAILED DESCRIPTION OF THE INVENTION

Figure 1:
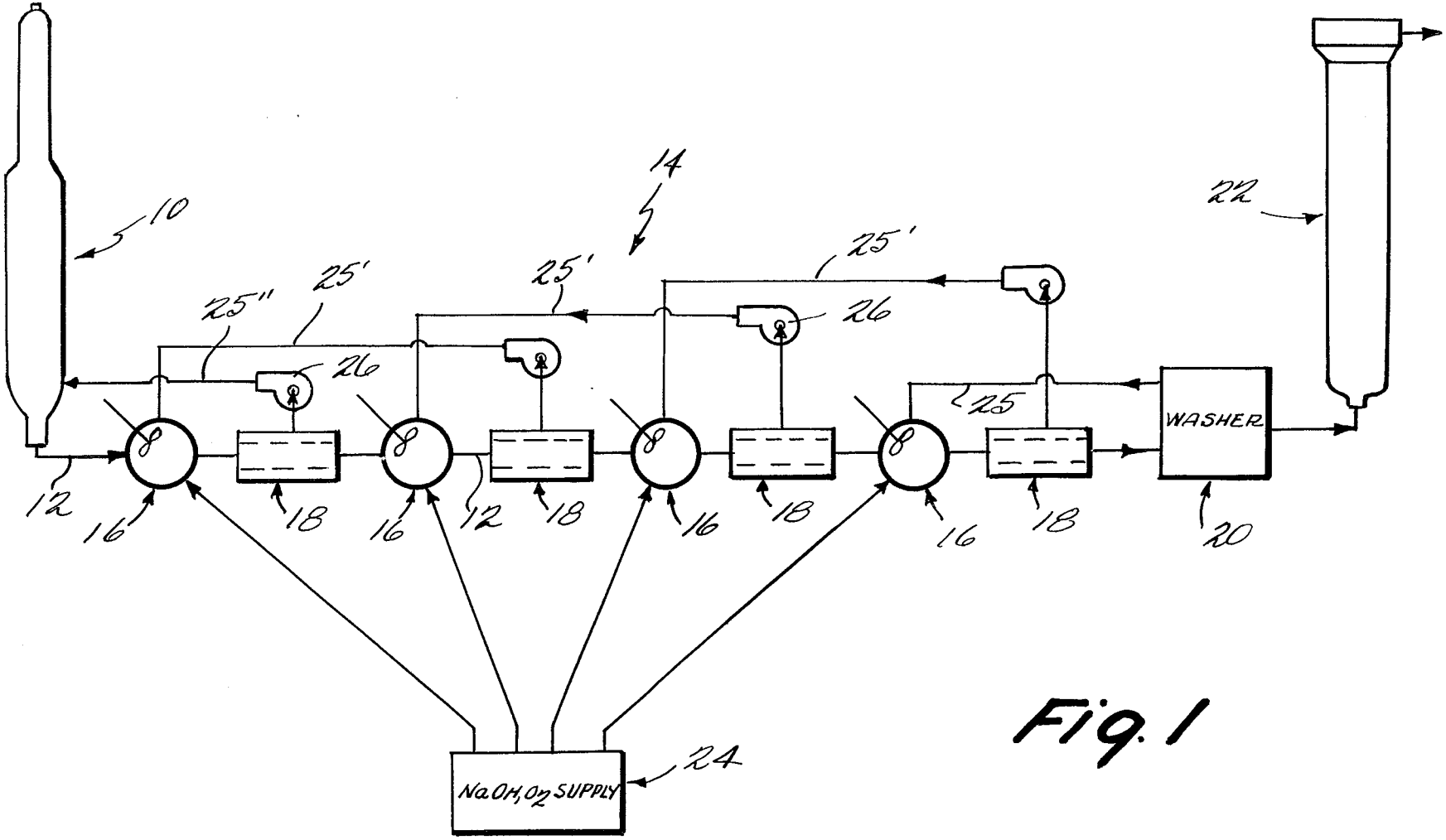
FIG. 1 is a schematic view showing exemplary apparatus according to the present invention.

Apparatus according to the present invention is shown schematically in FIG. 1 and includes a continuous digester 10 (such as a Kamyr continuous digester) having a discharge line 12, with means 14 for treating digested pulp in discharge line 12 to effect oxygen bleaching thereof with subsequent reduction of the Kappa number of the pulp. The pulp is normally discharged into line 12 at a consistency of about 8 to 15%. The means 14—which may be in a line 12 distinct from the digester discharge—includes a plurality of mixing means 16 disposed in line 12, including a first and last mixing means 16, for mixing digested pulp with $O_2$, NaOH solution, and water so that pulp fed therein at a consistency of about 8 to 15% is discharged at a second consistency less than the first consistency (i.e. about 4 to 8%), and a plurality of thickening means 18 disposed in line 12 in series and including a first and a last thickening means 18, each thickening means 18 being disposed in the discharge from a mixing means 16 so that pulp at the second consistency received by each thickening means 18 is thickened to generally the first consistency. A conventional washing tower 20 or the like is provided as means for washing pulp discharge by the last thickening means 18 of the series. Further treatment means 22—such as a chlorine bleaching tower or the like (as shown in U.S. Pat. No. 3,815,386)—is connected to the discharge from washer 20 to effect further treatment of the pulp to reduce the Kappa number thereof to any desired value. Means for adding NaOH and $O_2$ to each mixing means 16 includes a common supply 24 or the like, the proper amount being provided to effect controlled oxygen bleaching.

Figure 2:
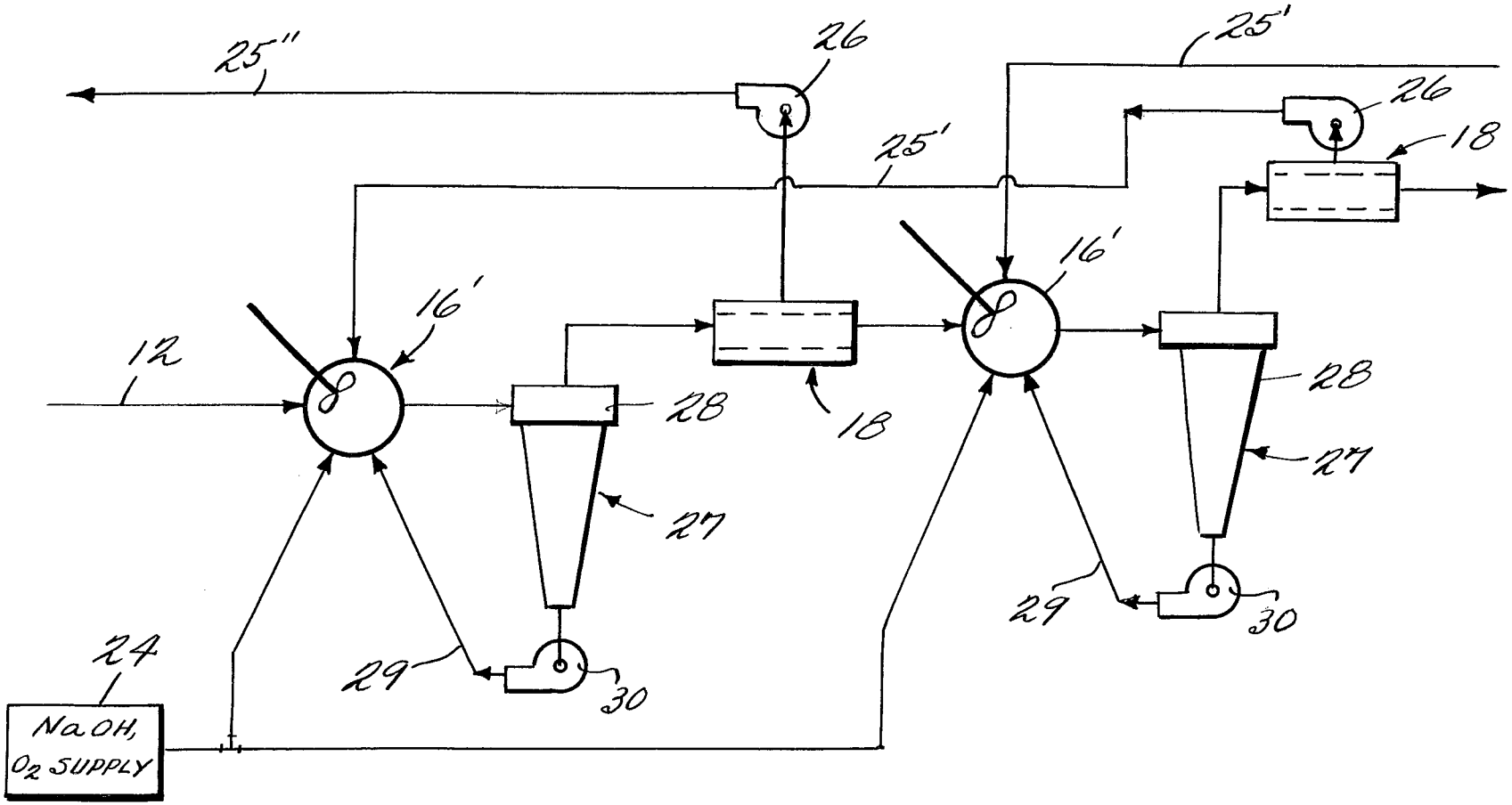
FIG. 2 is a schematic view showing a portion of the apparatus of FIG. 1, with fibrilizing and shive removing means.

Approximately 90% of the oxygen bleaching that is to take place upon addition of a given amount of $O_2$ takes place in the first two minutes, therefore the majority of oxygen bleaching takes place in each mixing means 16 and in the portion of the discharge line 12 connecting the mixing means to the subsequent thickening means 18. The mixing means 16 may be of any conventional type for effecting $O_2$, pulp mixing such as the mixer shown in U.S. Pat. Nos. 3,284,055 (FIGS. 3 and 4) and 3,366,367, and co-pending application Ser. No. 665,576, filed Mar. 10, 1976 now U.S. Pat. No. 4,093,506, the disclosure of each of which is hereby incorporated by reference in the present application. The water for mixing by the mixing means 16 preferably is provided for each mixing means 16 from a subsequent stage in the treatment. For instance, means may be provided for circulating hot water from counter-current washing in washer 20 to the last of the mixing means 16 in the series, such means comprising a line 25, and means are provided for recycling back to a previous mixing means 16 in the series, liquid withdrawn from at least one of the thickening means 18 to provide water for mixing in the previous mixing means, such recycling means including a line 25' with a pump 26 disposed therein. Preferably a line 25' and pump 26 is provided associated with each of the thickening means, the first thickening means 18 in the series having a line 25'' connected back to the digester 10 for providing wash water in the digester 10. By recycling the wash media, all the material possible is retained in the system, the withdrawn washing liquid from the continuous digester 10 being withdrawn by conventional means and passed on to a recovery station.

Where the pulp discharged in line 12 is contemplated to have a significant number of shives, and/or to effect more intimate mixing, fibrilizing means 16'—shown schematically in FIG. 2—may be provided as at least one of the mixing means for effecting at least partial fibrilizing of the pulp. The fibrilizing mixing means 16' may comprise any suitable conventional defibrillator, such as a defibrator refiner model L42. When a fibrilizing mixing means 16' is provided there is further provided at least one means 27 for separating shives from the pulp discharged from the fibrilizing mixing means 16' and for returning the shives to the fibrilizing mixing means 16', while passing the pulp to a subsequent thickening means 18. The means 27 includes a conventional cyclone separator 28 or the like, a return line 29 leading from the separator 28 back to the mixing means 16', and a pump 30 disposed in line 29.

By mixing and then thickening according to the present invention, the reactive products of the oxygen bleaching are washed out in much the same manner as in known chlorine displacement bleaching process which utilizes washing equipment. Washing equipment would generally be used for liquid systems and could not effect the gaseous oxygen bleaching according to the present invention, however, and with the thickeners 18, less chemical can be used, there is better control over the reaction, and less capital investment is necessary; yet the reaction products are removed substantially immediately after formation and during bleaching. Each thickener 18 comprises a thickener capable of thickening pulp at superatmospheric pressure and at a temperature of over 100° C. so that the pulp in a digester discharge line 12 may be directly treated without any intermediary steps. Preferably also the thickener is an in-line thickener, which is inexpensive and may be inserted directly in the discharge line 12, no accessory vessels being necessary to effect treatment. Exemplary thickeners 18 that may be utilized to practice the invention and are especially adapted for practicing the invention are shown in copending applications Ser. Nos. 676,659, now U.S. Pat. No. 4,029,579, and 676,660, filed Apr. 13, 1976 now U.S. Pat. No. 4,041,560, although the invention is not restricted to those particular thickeners. Such thickeners are illustrated in FIGS. 3 and 4 of the drawings.

Figure 3:
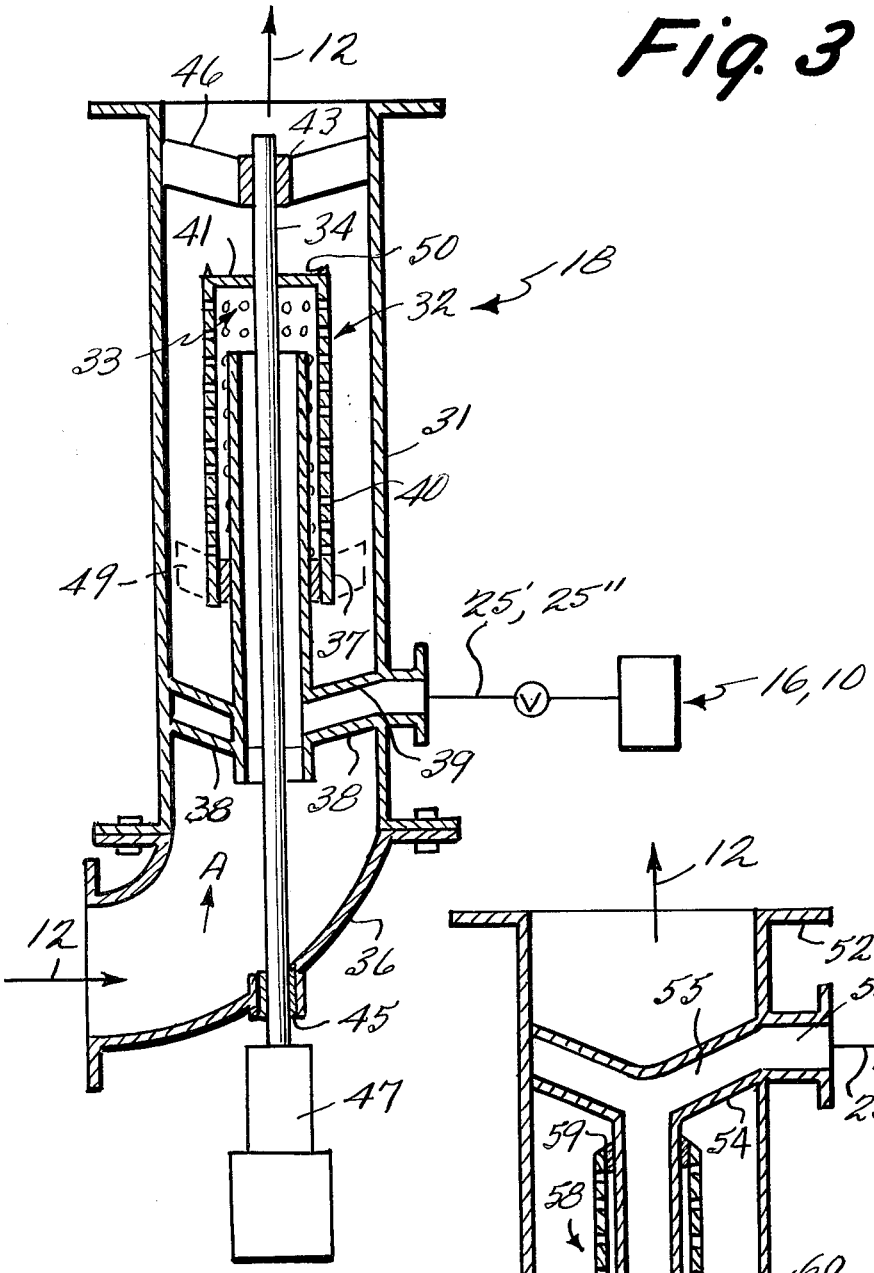
FIG. 3 is a cross-section view of an exemplary thickener that may be employed in the apparatus of FIGS. 1 and 2.
Figure 4:
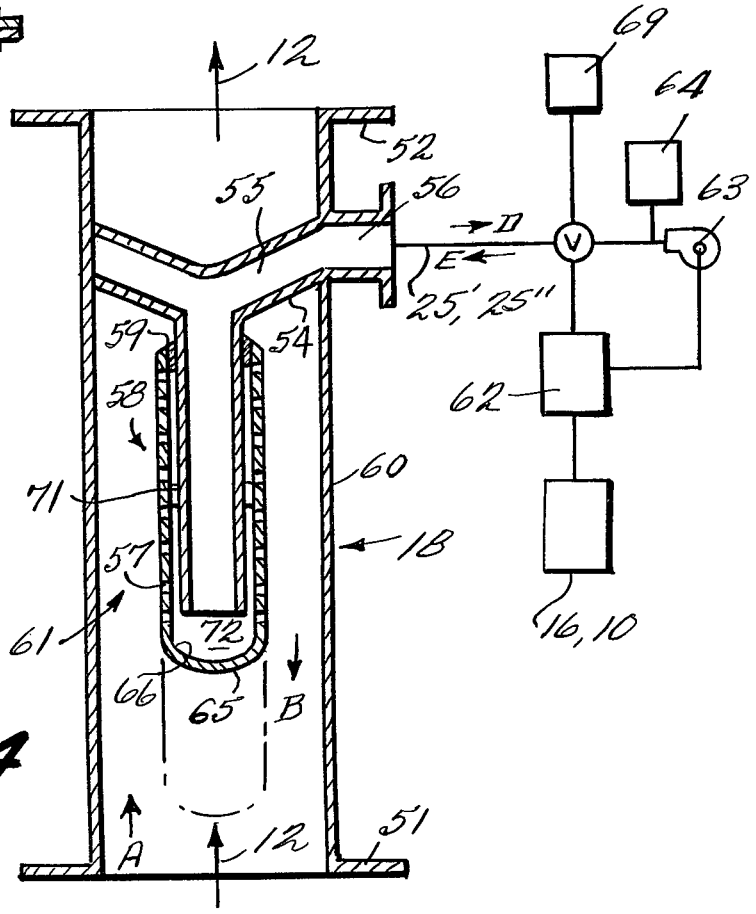
FIG. 4 is a cross-sectional view of another exemplary thickener that may be employed in the apparatus of FIGS. 1 and 2.

One exemplary thickener 18 that is especially useful in practicing the invention is shown in FIG. 3 (U.S. Pat. No. 4,041,560). The thickener of FIG. 3 comprises a generally cylindrical container 31 forming part of discharge line 12 through which the suspension flows in a first direction A, the container having an axis extending generally parallel to the first direction A, screen means 32 for removal of a portion of the liquid from the suspension flowing through the container 31, the screen means 32 having an interior variable volume chamber 33, mechanical means 34 for reciprocating the screen means 32 in the first direction A and in a second direction B opposite to the first direction A so that the volume of the interior chamber 33 of the screen means 32 is varied, and the discharge line 25, 25" being connected to the interior chamber 33 of the screen means 32 for expelling liquid separated from the suspension to an area remote from the container 31.

The container 31 may comprise a pipe member of a diameter of about 500 millimeters, having an inlet 36 thereto. Within the container 31 there is disposed a stationary tubular member 37, supported at one end thereof by a plurality of radially extending arm members 38, at least one of the radially extending arm members having an opening 39 formed therethrough. Mounted for movement over the stationary tubular member 37 is the screen means 32, the screen means comprising a tubular screen member 40 having one end, 41, thereof closed, and the other end thereof open, a sealing means 42 being provided at the open end for engagement with the exterior of tubular stationary member 37 during reciprocal movement of the member 40 with respect to the member 37. The interior variable volume chamber 33 is defined by the closed end 41, the tubular member 40, and the stationary tubular member 37. The rod 34 is operatively connected to the tubular screen member 40 at closed end 41 thereof for providing mechanical reciprocation of the screen means in the first direction A and in the second direction B. The rod member 34 is mounted for reciprocation by bushings 43, 44 and 45, the bushing 43 being mounted by a spider member 46 operatively connected to the container 31, the bushing 44 being supported by the stationary tubular member 37, and the bearing 45 extending through the portion 36 of container 31.

The rod member 34 may be reciprocated by any suitable means such as a hydraulic piston 47 shown in FIG. 3. The hydraulic piston and cylinder 47 is so arranged that during movement of the screen means 32 in the first direction A, the screen means 32 moves with substantially the same velocity as the suspension flowing in direction B in container 31 and during movement of the screen means 32 in direction B, the screen means 32 is moved with a substantially greater velocity. The velocity of the rod member 34 in the second direction B is large enough so that the variable volume interior chamber 33 of the screen means 32 decreases at a rate with respect to the rate of movement of liquid into the interior chamber 33 through the screen member 40 so that backflushing of the screen member 40 takes place. During the backflushing operation, however, liquid will continuously flow through the chamber 48 of the hollow stationary tubular member 37, through opening 39 to a mixing means 16 (or 16') or digester 10. The hydraulic piston and cylinder 47 is also arranged so that the rod member 34 may rotate with respect to the container 31, and means are provided mounted on screen member 40 that effect rotary movement of the screen member 8 when it is moving in direction B. Such means may take form of a plurality of wing shaped vanes or fins 49 (in dotted line of FIG. 3) which can be twisted or angled so that upon relative movement of the member 40 with respect to the suspension flowing through the container 31 the member 40 is rotated. This relative rotation also facilitates cleaning of the screen 40. Additionally, there is also associated with the screen means 32, means for generating a turbulence in the suspension when the screen means 32 is moved with respect thereto. The turbulence has a positive influence in that if a plurality of screen means 32 are provided in series in the container 31, different portions of the suspension will be brought into operative association with the succeeding screen means 32. The turbulence inducing means may comprise a tooth portion 50 of the closed end 41 of the screen means 32, or a circular edge member of the closed end 41, the means 50 also effecting a shredding or mixing of the suspension.

Liquid that is separated out from the suspension flowing in container 31 flows into chamber 33 through chamber 48 in stationary tubular member 37, through opening 39, and to line 25', 25". The line 25 may also have disposed therein conventional pressure resistance devices and flow quantity regulators (not shown).

An exemplary operation of the FIG. 3 thickness 18 will be set forth. Suspension to be dewatered, at approximately 8–15% solids concentration, flows in direction A through elbow portion 36 of container 31 into the container 31. The rod member 34 is moved upwardly in direction A at substantially the same velocity as the suspension flowing in container 31 by the hydraulic piston and cylinder arrangement 47 or the like, and during this upward movement liquid flows through the openings in the tubular movable screen member 40 into the variable volume interior chamber 33 thereof, through interior passageway 48 in stationary tubular member 37, through opening 39, and into line 25'. When the screen means 32 has reached its upward limit of travel (as by closed end 41 thereof abutting bushing 43) the hydraulic cylinder moves the rod member 34 downwardly in direction B with a velocity greater than the upward velocity of the suspension in container 31, and relative rotation of the rod member 34 with respect to the container 31 is effected during this movement in direction B by the force of the suspension acting on fins 49 (the rotation during each downward movement is approximately 120°–240°). The movement in direction B is with a velocity great enough so that the variable volume of the interior chamber 33 decreases at a rate with respect to the rate of movement of liquid into the interior chamber 33 through the screen means 32 so that back-flushing of the screen member 40 takes place. Turbulence in the suspension is also generated by the means 50 associated with screen means 32. During the downward movement of the screen means 32 in direction B, liquid is continuously expelled through the opening 39 into line 25'. When the screen means 32 reaches its downward limit of travel (as by portion 42 thereof abutting arm members 38) the hydraulic cylinder and piston arrangement 47 is again operated to move the rod member 34 upwardly in direction A, and the process is continued and repeated. The length of the stroke of movement of the rod member 34 in either direction is relatively small, for example, 0–100 centimeters, preferably 20–50 centimeters; the stroke can suitably be approximately ½ the length of screen member 40.

Another exemplary thickener 18 for use according to the invention is shown in FIG. 4 (U.S. Pat. No. 4,029,579). The apparatus of FIG. 4 includes a cylindrical circular cross-section housing 60, having bottom and top flanges 51 and 52, respectively, through which a suspension of comminuted fiber liquid flows in a direction B and having a piston 61 therein. A fixed hollow piston part 53 is provided, in communication with at least one opening 55 in a plurality of radially extending supporting arms 54, the opening 55, through connection 56, leading to a mixing means 16 or digester 10. The movable portion of the piston 61 is shown generally at 58 in FIG. 4, and includes a cylindrical body having screen openings 57 disposed along the length thereof. Seals 59 and 70 are provided to allow relative movement of the member 58 with respect to the portion 53. First and second piston faces 65, 66, are provided respectively on cylindrical body 58. Internal chamber 71, 72 of piston 61 communicate with the opening 55 and the interior of container 60 (through screen openings 57). A valve 68 may be disposed in line 25', as may a pump 63 and accumulator 64, the valve 68 being controlled by remote control means 69 to provide flow through line 25' in either direction D or direction E.

Operation of the thickener 18 of FIG. 4 is as follows: a suspension of comminuted fiber material and liquid flows upwardly in direction A into container 60, the suspension acting on first piston face 65 of member 58 to move the member 58 upwardly in direction A from the dotted line position shown in FIG. 4 to the solid line position shown in FIG. 4. Since the movement of member 58 is controlled by the velocity of the suspension in container 60, the member 58 moves upwardly substantially with the velocity of the suspension. During movement of the member 58 in direction A, liquid passes through screen openings 57 into chamber 72, while fiber material in the suspension is prevented from passing into chamber 72. The separated liquid flows from chamber 72, through hollow member 53 through outlet 56, and into line 25'. The control means 69 may control valve 68 so that it allows flow of fluid in direction D, to reservoir 62 and ultimately mixing means 16 or digester 16. When the member 58 reaches its upward limit of travel in direction A, the control means 69 controls valve 68 so that flow in direction d is prevented and flow in direction E is allowed. Separated liquid under pressure of pump 63 and accumulator 64 from reservoir 62 then flows in direction E through outlet 56 into chamber 72, abutting on second piston face 66, and forces the member 58 downwardly in direction B. The pressure provided by pump 63 and accumulator 64 can be controlled so that the piston 58 moves downwardly in direction B much more quickly than it moves upwardly in direction A. Once the downward limit of travel of member 58 has been reached, control means 69 again activates valve 68 to allow flow in direction D into 16, 10 so that dewatering again takes place. During downward movement of the member 58 in direction B, under the influence of fluid flowing in direction B, some backflushing takes place, cleaning the openings in screen 57. It is apparent from an inspection of the apparatus of FIG. 4 that the movable member 58 can be made relatively light weight, and thereby the forces for initiating action thereof are relatively small.

The apparatus of FIG. 4 can be made relatively small and readily installed in discharge line 12, even when line 12 is of relatively small diameter (i.e., 500 millimeters inside diameter). The "stroke" of the member 58 may be 0–100 centimeters, preferably about 20–50 centimeters. A plurality of devices 6, 58 may be arranged in series to provide any given amount of dewatering required. Also, while the flow of suspension has been shown in upward direction A, the flow of suspension may be in the downward direction B, suitable modification of the apparatus to accommodate the suspension movement in the downward direction B being relatively simple.

The apparatus according to the present invention having been described, the method according to the present invention will now be set forth. Oxygen and NaOH solutions are added to digested pulp to effect oxygen bleaching thereof, reaction products being formed during oxygen bleaching. A supply 24 provides the oxygen and NaOH solution to effective bleaching. This addition may be accomplished by adding water (i.e. from lines 25 or 25') with the $O_2$ NaOH solution, and mixing the pulp, water, $O_2$ and NaOH solution (as in mixing means 16). The formed reaction products are removed substantially immediately after formation thereof, and during oxygen bleaching, from the digested pulp. This removal is accomplished by thickening the pulp (as by means 18) to about its original consistency. The addition of oxygen and removal of reaction product steps are consecutively repeated until pulp bleached to a desired Kappa number (i.e. about 15 or below) is produced. The pulp preferably originally is at a consistency of about 8 to 15% when the oxygen and NaOH solution and water added thereto, the pulp being diluted to about 4 to 8% consistency and then thickened back to the original consistency of about 8 to 15%, but the invention is not limited to these consistency changes.

According to the present invention the digestion of pulp can be stopped at a Kappa number of about 70 (instead of 35 as conventionally), and the oxygen bleaching can be used to reduce the Kappa number further. This results in a higher yield compared to digestion of the fiber material to a Kappa number of about 35. According to the present invention the oxygen bleaching can be used to reduce the Kappa number from 70 to a Kappa number 15 or even below 15, with reduced chemical use as compared to chlorine bleaching, and a much lower pollution load. Additionally, the oxygen stage effluent can be retained in the system (as by subsequently feeding the discharge from the first thickener to the digester 10, and subsequent recovery by conventional means).

According to another aspect of the method of the present invention, cellulosic fiber material is treated by the steps of digesting the fiber material by treatment with digesting liquid (in digester 10) to produce digested pulp having a first consistency of about 8 to 15% and then oxygen bleaching the pulp by (1) mixing the pulp with $O_2$, NaOH solution, and water, thereby forming an integral mixture of pulp with $O_2$ at a second consistency less than the first consistency (i.e., about 4 to 8%), (2) thickening the integral mixture to return it to a consistency generally the same as the first consistency (i.e., about 8 to 15%), and (3) repeating steps 1 and 2 until a desired level of oxygen bleaching is achieved. Then the oxygen bleached pulp is then washed (in washer 2). The water for mixing the pulp to effect the oxygen bleaching is provided by water removed during a subsequent thickening operation, and all the effluent from the thickeners is retained in the system, and may ultimately be passed to the continuous digested 10 for use as wash media therein. The wash water for the last thickener 18 may be provided from the washing means 20. The oxygen bleaching may be accomplished at digester pressure and temperature conditions (over 100° C. and superatmospheric pressure).

It will be seen according to the present invention a method and apparatus have been provided having numerous advantages over the prior art for effecting treatment of cellulosic fiber material including oxygen bleaching. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method for treating cellulosic fiber material comprising the steps of digesting the cellulosic fiber material by treatment with digesting liquid in a digester to produce digested pulp having a first consistency of about 8–15%;

oxygen bleaching the pulp by treating it at a plurality of different in-series zones, including a first zone, and a last zone, each zone including a mixing stage and a thickening stage;

mixing the pulp with $O_2$, and with water and NaOH, at each mixing stage to form an integral mixture of pulp with $O_2$ at a second consistency less than the first consistency, and then substantially immediately thickening the integral mixture at each thickening stage corresponding to each mixing stage to return the mixture to a consistency substantially the same as the first consistency by removing water therefrom;

after oxygen bleaching in the last zone, washing the oxygen bleached pulp at a washing zone;

supplying water for the last oxygen bleaching zone mixing stage from the washing zone; and supplying water for each oxygen bleaching zone mixing stage preceding the last zone with water withdrawn from the next subsequent zone thickening stage.

2. A method as recited in claim 1 wherein digesting is accomplished in a continuous digester, and comprising the further step of feeding water withdrawn from the first oxygen bleaching zone thickening stage to the continuous digester for providing wash water therein.

3. A method as recited in claim 2 wherein said fiber material is digested at first pressure and temperature conditions, and wherein said oxygen bleaching is effected at substantially said first pressure and temperature conditions.

* * * * *